US009403175B2

(12) United States Patent
Boyles

(10) Patent No.: US 9,403,175 B2
(45) Date of Patent: Aug. 2, 2016

(54) SPRINKLER

(71) Applicant: Jamie Scott Boyles, Yarragon (AU)

(72) Inventor: Jamie Scott Boyles, Yarragon (AU)

(73) Assignee: PLATYPUS FIRE PTY. LTD., Yarragon, Victoria (AU)

( * ) Notice: Subject to any disclaimer, the term of this patent is extended or adjusted under 35 U.S.C. 154(b) by 214 days.

(21) Appl. No.: 13/679,223

(22) Filed: Nov. 16, 2012

(65) Prior Publication Data

US 2013/0140379 A1 Jun. 6, 2013

(30) Foreign Application Priority Data

Nov. 16, 2011 (AU) ..... 2011904791

(51) Int. Cl.

| | |
|---|---|
| ***B05B 3/04*** | (2006.01) |
| ***B05B 3/08*** | (2006.01) |
| ***B05B 3/02*** | (2006.01) |
| ***B05B 3/00*** | (2006.01) |
| ***B05B 3/10*** | (2006.01) |
| ***B05B 1/26*** | (2006.01) |
| ***B05B 15/06*** | (2006.01) |
| ***B05B 3/16*** | (2006.01) |
| ***B05B 3/06*** | (2006.01) |

(52) U.S. Cl.

CPC . *B05B 3/082* (2013.01); *B05B 1/26* (2013.01); *B05B 1/267* (2013.01); *B05B 3/008* (2013.01); *B05B 3/02* (2013.01); *B05B 3/04* (2013.01); *B05B 3/0486* (2013.01); *B05B 3/063* (2013.01); *B05B 3/08* (2013.01); *B05B 3/1007* (2013.01); *B05B 3/165* (2013.01); *B05B 15/069* (2013.01)

(58) Field of Classification Search

CPC ..... B05B 3/02; B05B 3/0486; B05B 3/1007; B05B 3/008; B05B 3/165; B05B 3/08; B05B 3/04; B05B 1/267; B05B 1/26; B05B 15/069; B05B 3/082; B05B 3/063

USPC ..... 239/214, 222.11, 222.13, 222.15, 239/222.17, 222.21, 231, 233, 380, 5, 18, 239/521, 523

See application file for complete search history.

(56) References Cited

U.S. PATENT DOCUMENTS 205,886 A * 7/1878 Merrill ..... 239/222.17
538,861 A * 5/1895 Boehmen ..... 239/222.17

(Continued)

FOREIGN PATENT DOCUMENTS

AU 2006235876 A1 5/2007

OTHER PUBLICATIONS

IP Australia, "Patent Examination Report No. 1" issued Dec. 24, 2013. Patent Application No. 2012254967.

*Primary Examiner* — Steven J Ganey
(74) *Attorney, Agent, or Firm* — Winstead PC

(57) ABSTRACT

In some embodiments the present disclosure provides a sprinkler comprising: a nozzle for projecting a stream of liquid in a first direction; and a spinner having a liquid deflecting surface, which is pivotally mounted in-line with the nozzle such that a stream of liquid from the nozzle impinges on the liquid deflecting surface; where the liquid deflecting surface is shaped such that the stream of liquid causes the spinner to spin and furthermore, where the liquid deflecting surface is shaped such that the stream of liquid is deflected in a second direction that is substantially transverse to the first direction. Additional embodiments of this disclosure pertain to the sprinkler that includes a frame, where the spinner is pivotally mounted on the frame.

11 Claims, 7 Drawing Sheets

(56) References Cited

U.S. PATENT DOCUMENTS

| | | | | | |
|---|---|---|---|---|---|
| 961,006 | A | * | 6/1910 | Perry | 239/222.17 |
| 1,693,245 | A | * | 11/1928 | Meng | 239/222.17 |
| 1,763,980 | A | * | 6/1930 | Nelson | 239/222.17 |
| 1,993,011 | A | * | 3/1935 | Lindberg | 239/222.17 |
| 2,488,234 | A | * | 11/1949 | Perry | 239/222.17 |
| 4,560,108 | A | * | 12/1985 | Rubinstein | 239/222.17 |
| 4,583,689 | A | * | 4/1986 | Rosenberg | 239/381 |
| 4,886,211 | A | * | 12/1989 | Cohen | 239/222.17 |
| 5,007,586 | A | * | 4/1991 | Cohen | 239/222.17 |
| 2008/0164341 | A1 | * | 7/2008 | Katzman et al. | 239/203 |

* cited by examiner

SPRINKLER

CROSS REFERENCE TO RELATED APPLICATIONS

This application claims priority to Australian Patent Application No. 2011904791, filed on Nov. 16, 2011, the entirety of which is incorporated herein by reference.

FIELD OF INVENTION

This invention relates generally to sprinklers.

BACKGROUND

Rotary sprinklers are often used to water gardens and can be simple or complex in configuration. Water under pressure is introduced to the sprinkler through a nozzle to cause a stream which then causes the sprinkler to rotate and disburse the stream through 360°. A number of rotary sprinklers can be used to water a large space such as a garden or a sporting field avoiding the need to use a hose to water the entire garden or sporting field.

A problem with many arrangements of rotary sprinklers is that they are either costly or involve a lot of moving parts. These types of rotary sprinklers which tend to send a stream of water upwards and are operated at high pressure to provide a mist may be suitable in a controlled environment such as a sporting field, but these types of sprinklers do not easily lend themselves to other situations such as fire prevention, and in particular sprinklers used in an outdoor setting where there is a possibility of bush fires or where a mist is unsuitable such as where leachate water is being used.

Therefore, it would be desirable to provide a rotary sprinkler which ameliorates or at least alleviates one or more of the above problems or provides an alternative.

SUMMARY

In some embodiments, the present disclosure provides a sprinkler including: a nozzle for projecting a stream of liquid in a first direction; a spinner having a liquid deflecting surface, which is pivotally mounted in-line with the nozzle such that a stream of liquid from the nozzle impinges on the liquid deflecting surface; where the liquid deflecting surface is shaped such that the stream of liquid causes the spinner to spin and furthermore, where the liquid deflecting surface is shaped such that the stream of liquid is deflected in a second direction that is substantially transverse to the first direction.

Advantageously, the rotary sprinkler of the present disclosure provides a flat trajectory for the stream which is very useful in a bushfire situation or where a mist is not suitable. In a further advantage, the rotary sprinkler of the present invention only includes one moving part. The flatter trajectory means the stream from the sprinkler is less affected by wind. The liquid used in the sprinkler is preferably water, but need not be limited to water, for example a liquid which contains fire suppressant agents or similar.

Preferably, the nozzle size is based on efficient water use but with the operating pressure ensuring the correct droplet size in the stream. In an embodiment the sprinklers are spaced about 3.5 meters apart and operated at a pressure of about 275 kpa.

In an embodiment of the present disclosure, the liquid deflecting surface includes a first transversely extending portion for deflecting the stream of liquid in a second direction that is substantially transverse to the first direction. The liquid deflecting surface acts to deflect the stream slightly from the first direction and turn the sprinkler head, while the first transversely extending portion ensures that the stream is substantially transverse to the first direction.

In a related embodiment of the present disclosure, the liquid deflecting surface also includes a first surface portion shaped such that the stream of liquid causes the spinner to spin. In an additional embodiment, the liquid deflecting surface may include a second surface portion shaped such that the stream of liquid causes the spinner to spin and a second transversely extending portion for deflecting the stream of liquid in a second direction that is substantially transverse to the first direction.

In an embodiment of the present disclosure, the first and second transversely extending portions for deflecting the stream of liquid in a second direction are shaped to further deflect the stream into a spray. Advantageously, both the first and second surface portions act to deflect the stream, but in opposite directions effectively splitting the stream and both surface portions act to turn the spinner in the same direction. The first transversely extending portion and second transversely extending portion both act to further deviate the stream such that the stream is substantially transverse to the first direction.

In a related embodiment, the first and second surface portions are curved and are integral with the first and second transversely extending portions respectively. Preferably, the first and second transversely extending portions are substantially transverse to the first direction and connected to the first and second surface portions respectively. The first and second surface portions are curved such that they cause the stream to deviate between 35° and 55° from the first direction. In a preferred form, the first and second surface portions are curved such that they cause the stream to deviate 45° from the first direction.

In further embodiments of the present invention the first and second transversely extending portions are substantially transverse to the first direction such that they cause the stream to deviate between 80° and 100° from the first direction. In a preferred embodiment, the first and second transversely extending portions are substantially transverse to the first direction such that they cause the stream to deviate 90° from the first direction.

Additional embodiments of this disclosure pertain to sprinkler that includes a frame, where the spinner is pivotally mounted on the frame. In a related embodiment, the sprinkler may also include a base attached to the frame, where the nozzle is positioned in the base.

BRIEF DESCRIPTION OF THE FIGURES

The following description refers in more detail to the various features and steps of the present invention. To facilitate and understanding of the invention, reference is made in the description to the accompanying drawings where the invention is illustrated in a preferred embodiment. It is to be understood however that the invention is not limited to the preferred embodiment illustrated in the drawings.

DETAILED DESCRIPTION

It is to be understood that both the foregoing general description and the following detailed description are exemplary and explanatory only, and are not restrictive of the invention, as claimed. In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise.

The section headings used herein are for organizational purposes only and are not to be construed as limiting the subject matter described. All documents, or portions of documents, cited in this application, including, but not limited to, patents, patent applications, articles, books, and treatises, are hereby expressly incorporated herein by reference in their entirety for any purpose. In the event that one or more of the incorporated literature and similar materials defines a term in a manner that contradicts the definition of that term in this application, this application controls.

Advantageously, the rotary sprinkler of the present disclosure provides a flat trajectory for the stream which is very useful in a bushfire situation or where a mist is not suitable. In a further advantage, the rotary sprinkler of the present invention only includes one moving part. The flatter trajectory means the stream from the sprinkler is less affected by wind. The liquid used in the sprinkler is preferably water, but need not be limited to water, for example a liquid which contains fire suppressant agents or similar.

Preferably, the nozzle size is based on efficient water use but with the operating pressure ensuring the correct droplet size in the stream. In an embodiment the sprinklers are spaced about 3.5 meters apart and operated at a pressure of about 275 kpa.

Figure 1:
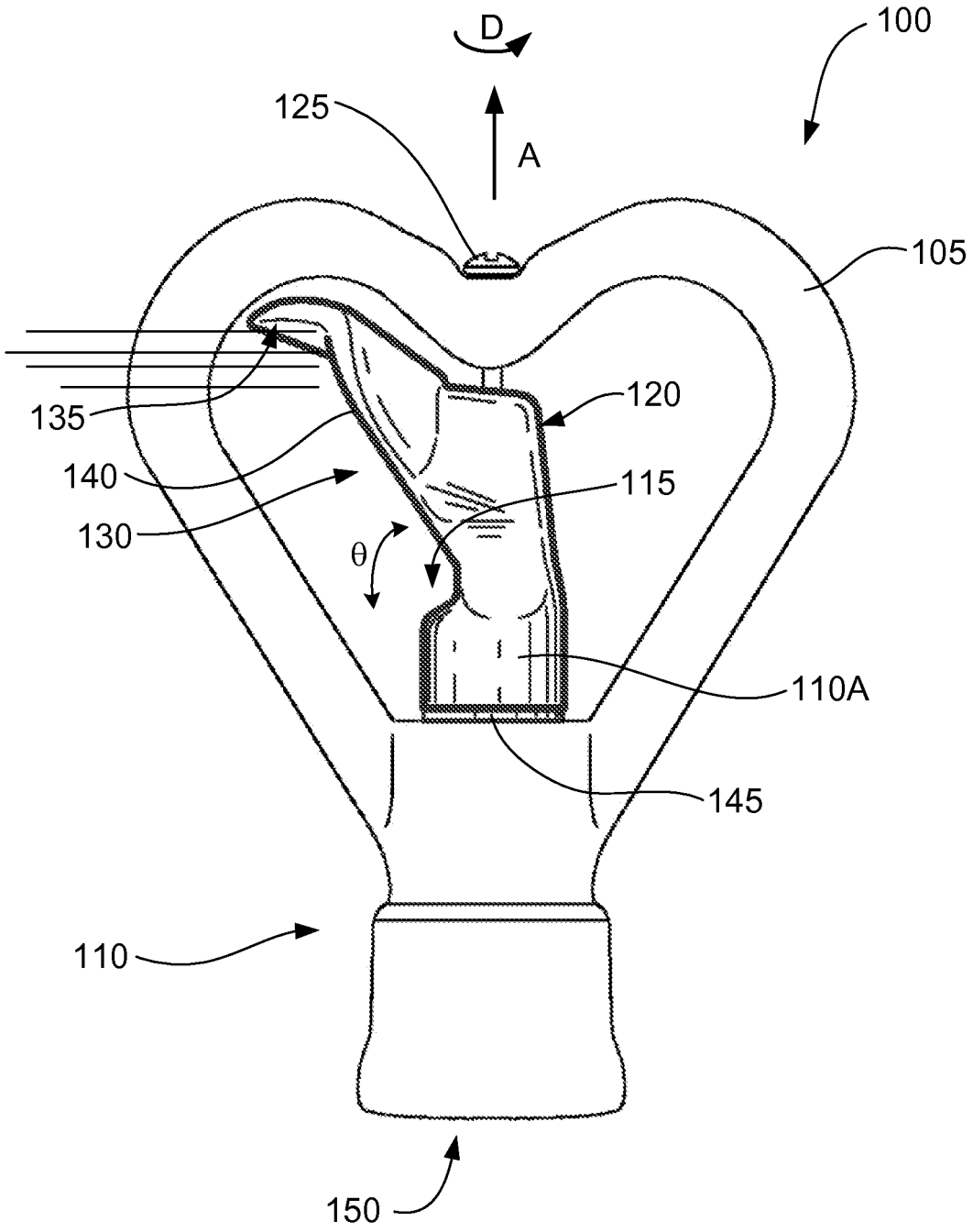
FIG. 1 shows a view of a rotary sprinkler according to a first embodiment of the invention.

The rotary sprinkler (100) illustrated in FIG. 1 includes a nozzle (115) for projecting a stream of liquid in a first direction A. A spinner (120) is provided and includes a liquid deflecting surface (130) and is pivotally mounted in-line with the nozzle (115) such that a stream of liquid from the nozzle impinges on the liquid deflection surface (130). A frame (105) may be provided which is attached to or integral with a base (110). The frame (105) may take the form of a "heart shape" as shown in FIG. 1 or may be a "half heart shape" having only one arm extending from the base (110) to the pivot (125). The nozzle (115) may be provided in the base (110) and may extend through the base to receive water under pressure and to provide a stream in a first direction (A) of the rotary sprinkler (100). The nozzle (115) may include a valve arrangement such as a spring and poppet arrangement or rubber nozzle (as described with reference to FIG. 5). The spinner (120) is pivotally mounted on the frame (105) via a pivot (125) which allows for rotation of the spinner (120) through 360°. The base (110) may further include a mount (110A) on which the spinner (120) rests. Between the mount (110A) and the spinner (120) is a washer (145).

Figure 2:
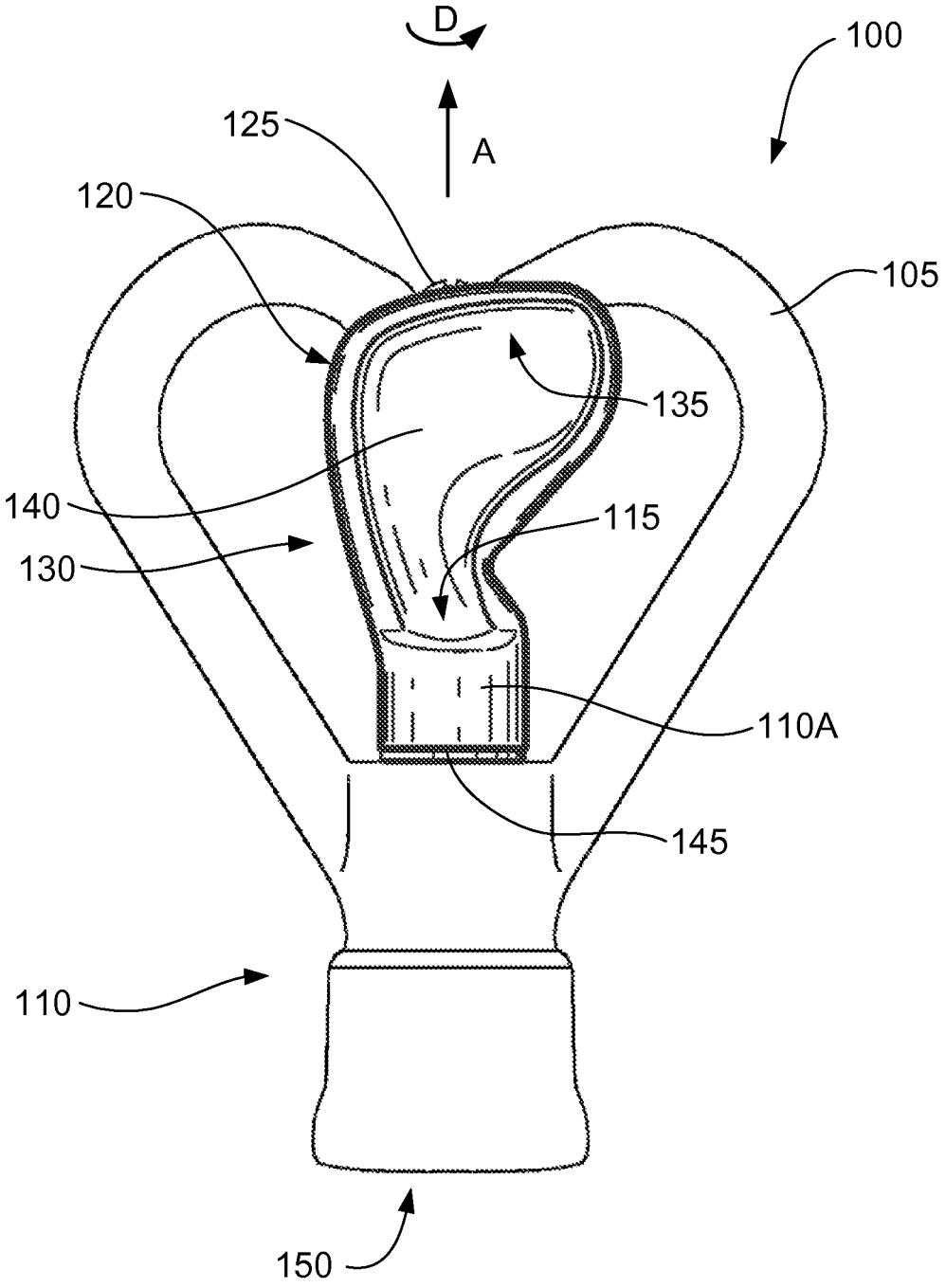
FIG. 2 depicts the rotary sprinkler of FIG. 1 with the sprinkler head rotated through 90°.

As can be best seen with reference to FIGS. 1 and 2, the spinner (120) includes a liquid deflecting surface (130) having a first transversely extending portion (135) and first surface portion (140). The spinner (120) is pivotally mounted via pivot (125) and in-line with the nozzle (115) such that a stream of liquid from the nozzle (115) impinges on the first surface portion (140) of the liquid deflection surface (130). The first surface portion (140) is shaped such that the stream of liquid from the nozzle (115) causes the spinner (120) to spin in a direction (D) and furthermore, the first transversely extending portion (135) is shaped such that the stream of liquid is deflected in a second direction that is substantially transverse to the first direction (A).

Preferably, the first transversely extending portion (135) is also shaped such that the stream of liquid is also further deflected into a spray. For example, the first transversely extending portion (135) may be a flat flange that extends from the first surface portion (140), the flat flange having a surface area to spread the stream into a spray. Preferably, the first surface portion (140) extends from the base (110) to the first transversely extending portion (135). The first surface portion (140) may be curved and the first transversely extending portion (135) is preferably substantially transverse to the first direction (A). In operation, water which is under pressure is passed through the base (110) and into the nozzle (115). In the absence of a spinner (120) the stream would continue travel in first direction (A). However, the presence of the spinner (120) causes the stream from the nozzle (115) to strike the first surface portion (130) of the spinner (120) resulting in the stream deviating from the first direction (A) through an angle θ. The angle θ may between 35 and 55° from the first direction (A) but is preferably 45° from the first direction (A). The stream then strikes the first transversely extending portion (135) which is substantially transverse to the first direction (A). This causes the stream to extend in a direction which is substantially transverse to the first direction (A). The first transversely extending portion (135) may be substantially flat such that it causes the stream to deviate between 80° and 100° from the first direction (A). In a preferred form, the first transversely extending portion (135) is substantially flat such that it causes the stream to deviate 90° from the first direction (A).

Advantageously, in the event of a bushfire situation the spinner (120) will ensure that the resulting spray is disbursed in a more flat manner but at the same time through 360°. In another advantage, in the event of the sprinkler being used at a landfill site, for example, leachate water (which may be toxic) from the site is sprayed out in a flat trajectory avoiding a spray and/or mist in an upwards direction (where wind can pick up the mist causing it to drift from the site).

The first surface portion (140) is also angled such that when the water strikes the first surface portion (140) it causes the spinner (120) to turn in a direction (D) about the pivot (125). The pivot (125) in this case is a screw which extends through the frame and into the sprinkler head (120) where it is secured. However, it will be appreciated that the pivot may be replaced by any other type of pivot (125). For example, the pin may be cast as part of the spinner (120) with a hollow cap that screws into the top of the frame (105) that locates the spinner centrally.

Advantageously, the use of a pin is simple and serviceable (if the pin fails). It will be appreciated that the frame (105) could be omitted and providing a shaft or pin extending from the base (110) and securing the spinner in place by a clip and washer arrangement but allowing the spinner to pivot about the pin.

In an embodiment, it is envisaged that the sprinkler would be used, for example on a roof of a house in a bushfire prone area and the flat spray would provide protection against embers. The sprinklers may be installed around the facia boards of the house or building that is to be protected. In operation the sprinklers act to provide a curtain of water downwards to assist in preventing heat build-up on glass (e.g. windows) and ignition of debris under decks etc. Further, part of the spray area may also act to wet gutters to prevent ignition of built up debris (for example, the sprinklers could be installed on a roof area near attic windows, solar collectors or air conditioning units etc). The sprinklers are preferably set up in zones to ensure water use is concentrated on the direction the fire is approaching from.

The sprinkler may be made from any suitable material but is preferably made of a material such as nylon 6 glass reinforced material, brass/gunmetal bronze or stainless steel. The washer (130) under the spinner (120) may be a fibre or metal material suitable to withstand high temperatures. It is envisaged that the sprinklers would be serviced annually and be checked or replaced as required after a bushfire.

Advantageously, the sprinkler (100) of the present invention includes only one moving part, namely the spinner (120). The base (110) and frame (105) if included, may be integral or cast together which is advantageous in a bushfire setting since the possibility of something going wrong with the rotary sprinkler could have a detrimental result. It is essential that the rotary sprinkler is operable when a bushfire occurs.

It will be appreciated that the mount (110A) may be omitted and the first surface portion (140) may extend down to the nozzle (115) and act to guide the stream from the nozzle (115) on to the first surface portion (140). In this case, the pivot (125) would act to position the sprinkler head (120) and to allow rotation of the sprinkler head (120).

Figure 3:
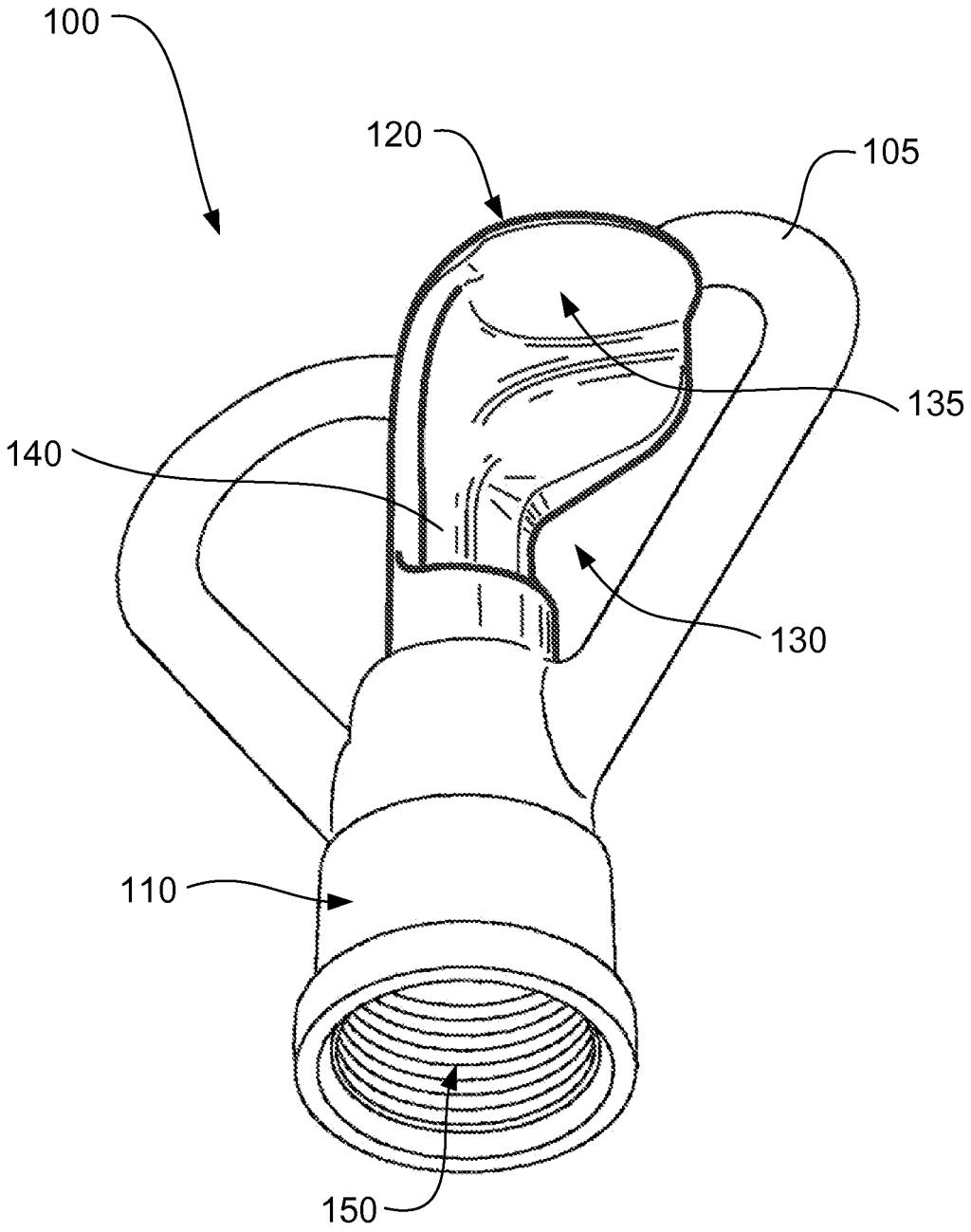
FIG. 3 shows an underside perspective view of the rotary sprinkler of FIGS. 1 and 2.

FIG. 3 shows a perspective view of the sprinkler (100) of FIGS. 1 and 2 showing a fitting (150) in the base (110) of the sprinkler (100). The fitting could be any type of fitting such that it can be attached to an existing sprinkling system. In this case the fitting (150) is a thread, but the fitting could be a snap lock arrangement or bayonet type connection typically fitted to copper or suitable metal tube, fitting (150) may also later include an optional built in pressure regulator for installations where sprinklers are installed at differing heights on a building.

Figure 4:
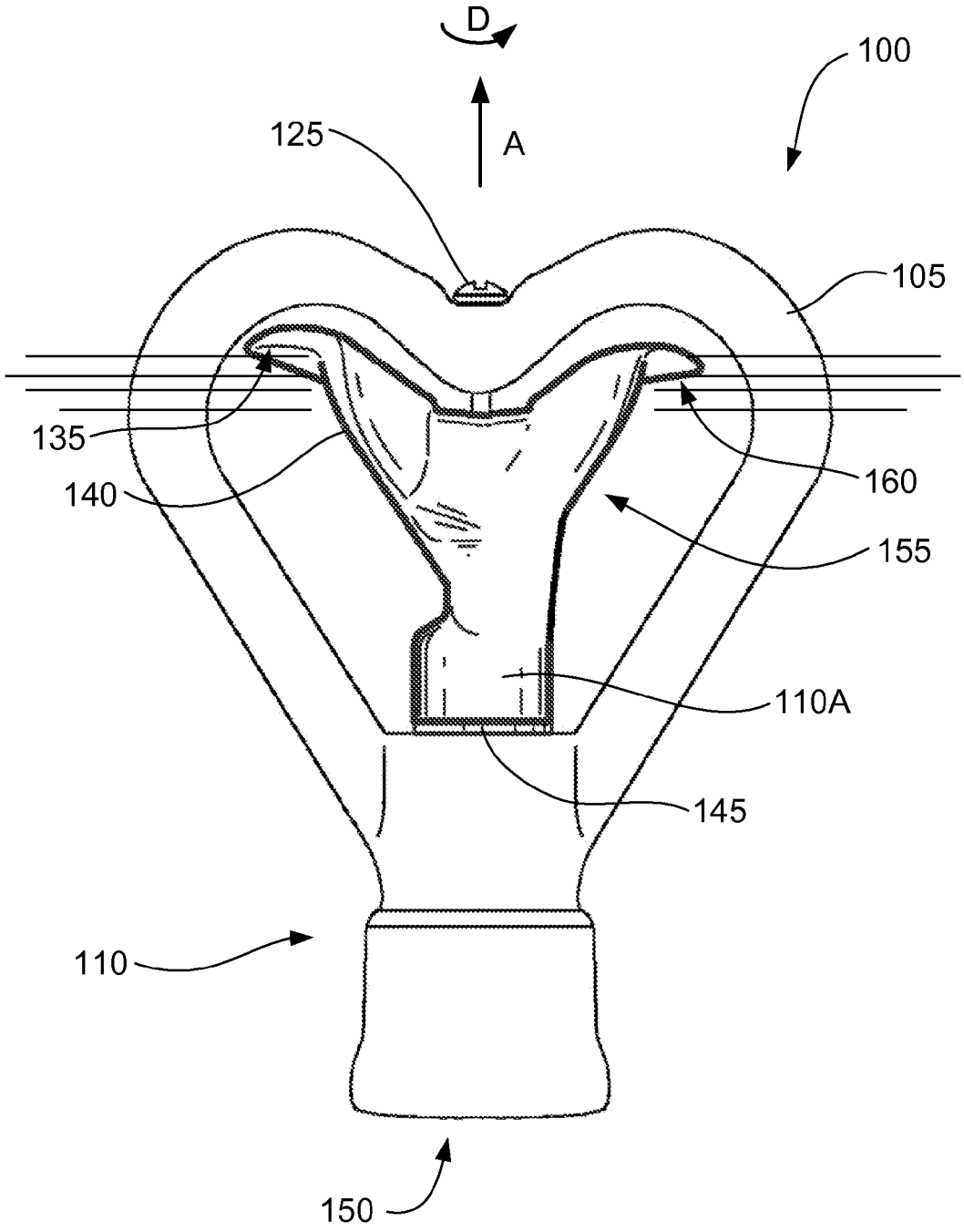
FIG. 4 depicts a second embodiment of the rotary sprinkler.

FIG. 4 is a sprinkler (100) according to a second embodiment of the invention in which a second surface portion (155) and second transversely extending portion (160) are provided on the spinner (120). In operation, the second surface portion (155) and second transversely extending portion (160) mirror operation of the first surface portion (140) and first extending portion (135). For example, the second surface portion (155) in combination with the first surface portion (140) both act to deflect the stream, but in opposite directions effectively splitting the stream, and both walls act to turn the spinner (120) in a direction (D). Similarly, the first transversely extending portion (135) and second transversely extending portion (160) both act to further deviate the stream such that the stream is substantially transverse to the first direction (A) and cause the stream to turn into a spray.

Figure 5A:
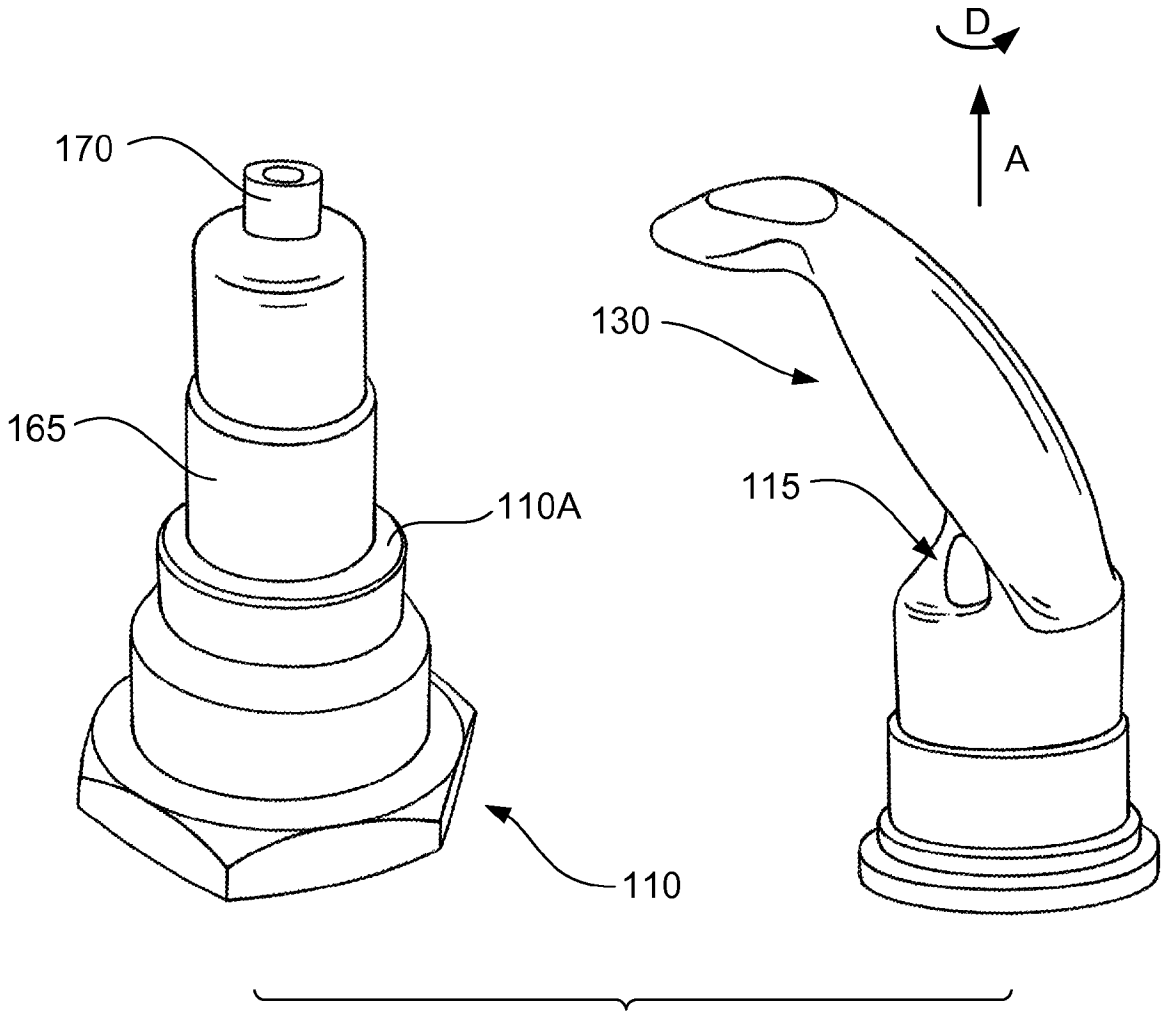
FIGS. 5A-5C show a third embodiment of the rotary sprinkler.

FIG. 5A, is a sprinkler (100) according to a third embodiment of the disclosure in which a frame is omitted. The rotary sprinkler (100) illustrated in FIG. 5A includes a nozzle (115) for projecting a stream of liquid in a first direction A. A spinner (120) is provided and includes a liquid deflecting surface (130) and is pivotally mounted in-line with the nozzle (115) such that a stream of liquid from the nozzle impinges on the liquid deflection surface (130). The spinner (120) is attached to or integral with a base (110). The nozzle (115) may be provided in the base (110) and may extend through the base to receive water under pressure and to provide a stream in a first direction (A) of the rotary sprinkler (100). The spinner (120) is pivotally mounted on the base (110) via a bearing (165) which allows for rotation of the spinner (120) through 360°. The base (110) may further include a mount (110A) on which the spinner (120) rests. Between the mount (110A) and the spinner (120) is a bearing (165) and rubber nozzle (170). The bearing (165) may be a fibre or metal material suitable to withstand high temperatures, for example Igus™ J350. The rubber nozzle (170) is preferably moulded from a compound such as F2619.

Figure 5B:
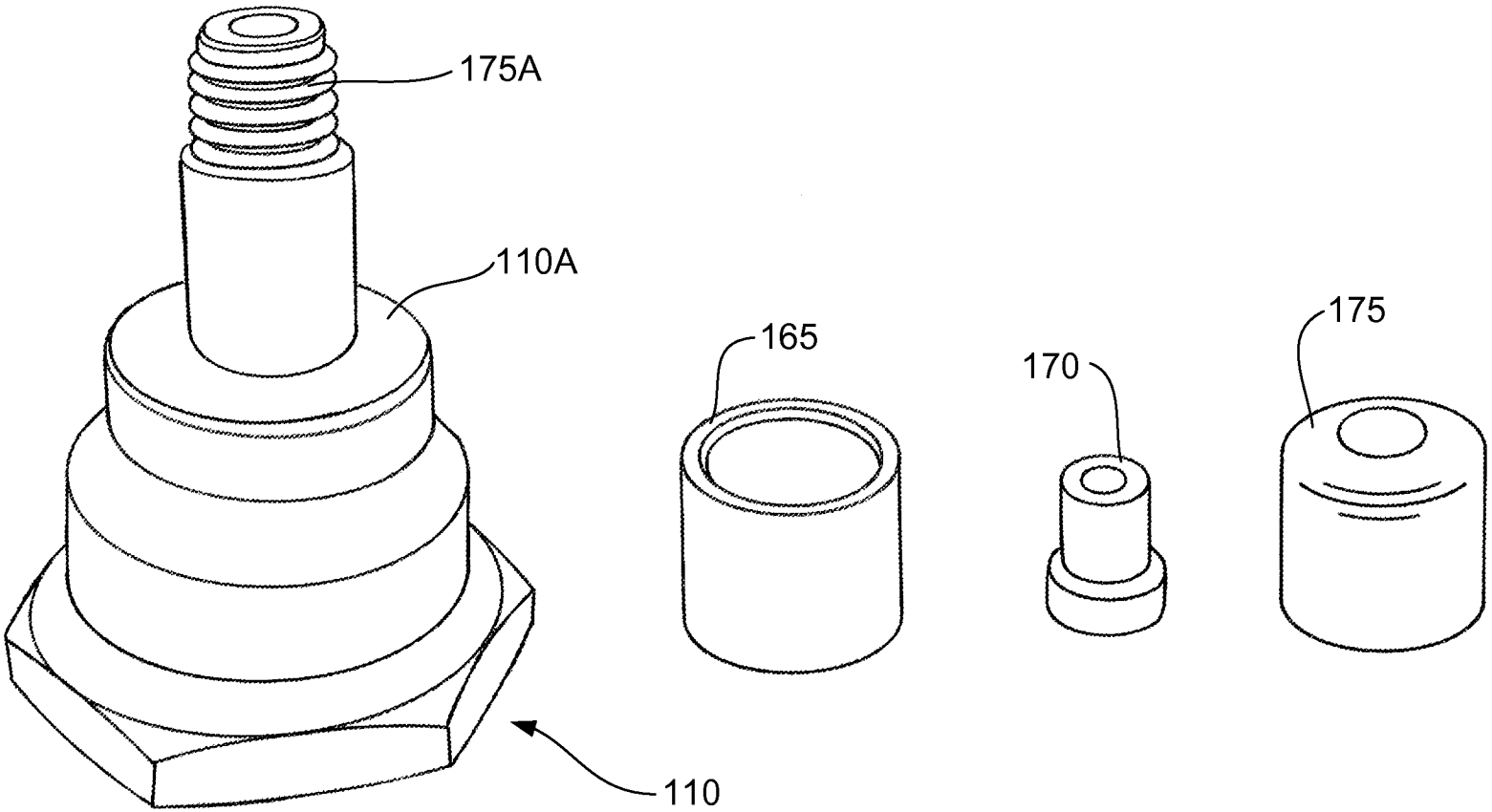

As can be best seen with reference to FIG. 5B, the base 110 includes a mount (110A) on which the spinner (120) rests. Also provided on mount 110A is a bearing to facilitate rotation of the spinner (120). The base 110 includes a cap 175 which is removably mounted to base (110) via threaded portion (175A). The cap (175) further includes a rubber nozzle (170) which is seated in the cap (175) and acts to prevent dust or vermin entering into the nozzle (115) and clogging the sprinkler (100). The rubber nozzle (170) may alternatively be a valve arrangement such as a spring and poppet arrangement.

Like the first and second embodiments, the spinner (120) includes a liquid deflecting surface (130) having a first transversely extending portion (135) and first surface portion (140). The spinner (120) is pivotally mounted on the base (110) via a bearing (165) and in-line with the nozzle (115) such that a stream of liquid from the nozzle (115) impinges on the first surface portion (140) of the liquid deflection surface (130). The first surface portion (140) is shaped such that the stream of liquid from the nozzle (115) causes the spinner (120) to spin in a direction (D) and furthermore, the first transversely extending portion (135) is shaped such that the stream of liquid is deflected in a second direction that is substantially transverse to the first direction (A).

Figure 5C:
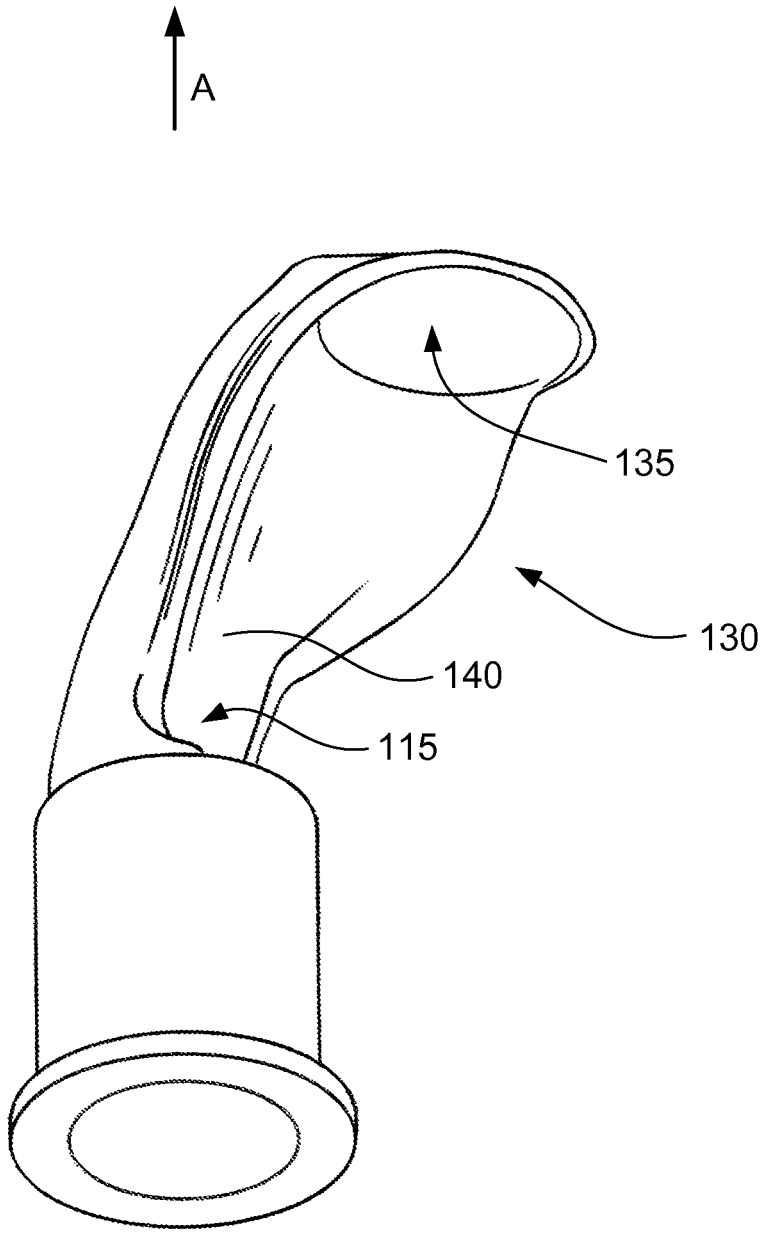

FIG. 5C more clearly shows the spinner (120) including the nozzle (115) for projecting a stream of liquid in a first direction A. The spinner (120) includes a liquid deflecting surface (130) having a first transversely extending portion (135) and first surface portion (140).

Without further elaboration, it is believed that one skilled in the art can, using the description herein, utilize the present invention to its fullest extent. The embodiments described herein are to be construed as illustrative and not as constraining the remainder of the disclosure in any way whatsoever. While the preferred embodiments have been shown and described, many variations and modifications thereof can be made by one skilled in the art without departing from the spirit and teachings of the invention. Accordingly, the scope of protection is not limited by the description set out above, but is only limited by the claims, including all equivalents of the subject matter of the claims.

The disclosures of all patents, patent applications and publications cited herein are hereby incorporated herein by reference, to the extent that they provide procedural or other details consistent with and supplementary to those set forth herein.

What is claimed is:

1. A sprinkler including:

a nozzle for projecting a stream of liquid in a first direction;

a spinner having a liquid deflecting surface and which is pivotally mounted in-line with the nozzle such that a stream of liquid from the nozzle impinges on the liquid deflecting surface;

wherein the liquid deflecting surface deflects the stream of liquid in a second direction that is substantially transverse to the first direction, and the liquid deflecting surface includes a first transversely extending portion transforming the stream of liquid into a spray; and a second transversely extending portion for deflecting the stream of liquid in a second direction that is substantially transverse to the first direction, wherein the second transversely extending portions for deflecting the stream of liquid is shaped to further deflect the spray of liquid into a flat trajectory spray.

2. The sprinkler of claim 1, wherein the liquid deflecting surface includes a first surface portion shaped such that the stream of liquid causes the spinner to spin.

3. The sprinkler of claim 2, wherein the liquid deflecting surface includes a second surface portion shaped such that the stream of liquid causes the spinner to spin.

4. The sprinkler of claim 3, wherein the first and second surface portions are curved and are integral with the first and second transversely extending portions respectively.

5. The sprinkler of claim 3, wherein the first and second transversely extending portions are substantially transverse to the first direction and are connected to the first and second surface portions respectively.

6. The sprinkler of claim 3, wherein the first and second surface portions are curved such that they cause the stream to deviate between 35° and 55° from the first direction.

7. The sprinkler of claim 3, wherein the first and second surface portions are curved such that they cause the stream to deviate 45° from the first direction.

8. The sprinkler of claim 3, wherein the first and second transversely extending portions are substantially transverse to the first direction such that they cause the stream to deviate between 80° and 100° from the first direction.

9. The sprinkler of claim 3, wherein the first and second transversely extending portions are substantially transverse to the first direction such that they cause the stream to deviate 90° from the first direction.

10. The sprinkler of claim 1, further including a frame, wherein the spinner is pivotally mounted on the frame.

11. The sprinkler of claim 10, further including a base attached to the frame, wherein the nozzle is positioned in the base.

* * * * *